US007931188B2

(12) United States Patent
Marinelli et al.

(10) Patent No.: US 7,931,188 B2
(45) Date of Patent: Apr. 26, 2011

(54) COMBINATION PIZZA BOX AND LEVELING DEVICE

(76) Inventors: Vito Marinelli, Frenchtown, NJ (US); Richard J. Macor, Asbury, NJ (US)

( * ) Notice: Subject to any disclaimer, the term of this patent is extended or adjusted under 35 U.S.C. 154(b) by 123 days.

(21) Appl. No.: 12/319,588

(22) Filed: Jan. 9, 2009

(65) Prior Publication Data

US 2010/0176137 A1 Jul. 15, 2010

(51) Int. Cl.
*B65D 5/44* (2006.01)
*F16M 11/20* (2006.01)

(52) U.S. Cl. ..... 229/104; 206/45.27; 224/275; 229/906; 248/148; 248/152; 248/188.2; 248/188.6

(58) Field of Classification Search ..... 229/104, 229/906; 224/275; 206/45.21, 45.25, 45.26, 206/45.27; 248/148, 188.2, 188.6, 150–152, 248/174, 188.8, 188.9, 188.91
See application file for complete search history.

(56) References Cited

U.S. PATENT DOCUMENTS 1,576,731 A * 3/1926 Jack ..... 206/45.25
1,778,212 A * 10/1930 Dugdale ..... 248/152
2,591,425 A * 4/1952 Guyer ..... 206/45.27
2,730,232 A * 1/1956 Coe ..... 206/45.26
2,875,940 A * 3/1959 Dunn ..... 224/275
3,178,242 A * 4/1965 Ellis et al. ..... 229/242
3,338,629 A * 8/1967 Drees ..... 224/275
3,499,595 A * 3/1970 Brooks ..... 229/104
4,030,596 A * 6/1977 Snyder et al. ..... 206/45.26
4,238,101 A * 12/1980 Kaye ..... 248/174
5,470,002 A * 11/1995 DiStefano et al. ..... 224/275
5,881,934 A * 3/1999 Hung ..... 224/275
5,961,035 A * 10/1999 Correll ..... 229/110
6,902,104 B2 * 6/2005 Holley et al. ..... 229/242
7,066,362 B2 * 6/2006 Marnell ..... 224/275
7,481,169 B2 * 1/2009 Larson ..... 224/275
2004/0060972 A1 * 4/2004 Harrelson ..... 229/104
2006/0243782 A1 * 11/2006 DeWolfe ..... 229/104
2008/0223913 A1 * 9/2008 Nadeau ..... 224/275

* cited by examiner

*Primary Examiner* — Gary E Elkins

(57) ABSTRACT

An embodiment of the present invention is a combination of a pizza box and leveling device for the pizza box. The pizza box has at least one sidewall that is formed having two adjacent panels with a cavity between the adjacent panels, and, a bottom that has at least one slot. The at least one slot is substantially aligned with and provides access to the cavity. And, the leveling device has at least one portion thereof formed for insertion into the at least one slot and further into the cavity of the sidewall of the pizza box so as to detachably attach the leveling device to the pizza box.

20 Claims, 3 Drawing Sheets

COMBINATION PIZZA BOX AND LEVELING DEVICE

FIELD OF THE INVENTION

The present invention relates to food storage containers for freshly baked pizza pies, and particularly to pizza boxes for transporting pizza pies in transportation vehicles.

BACKGROUND OF THE INVENTION

Pizza is a food enjoyed around the world by many people. When a pizza pie is ordered by a customer, it is typically baked and then put in a cardboard pizza box while still hot, for delivery to or pick-up by a customer. Transporting a freshly baked pizza can be challenging because the ingredients (especially when hot) tend to flow off the pizza pie if the pizza box is not kept reasonably level. A common place to rest a pizza box for transportation is on a seat surface of a transportation vehicle (car truck etc.), however, most seating surfaces are not level but tilted downward at the back to accommodate human ergonomics. So, if a freshly baked pizza in its box were placed on a seat surface for transportation, the ingredients usually flow off of the pizza during transportation. Worse yet, unless a pizza box is secured it often slides around on the seat banging into things or even falling off the seat during acceleration, deceleration, braking and/or turning of the transportation vehicle. So, a pizza pie can become compromised during transportation or even inedible if landing on the floor of the transportation vehicle. Accordingly, applicant believes there is a need to improve upon the means of containerization for transportation of fresh pizza pies.

SUMMARY OF THE INVENTION

An embodiment of the present invention is a pizza box and leveling device for the pizza box. The pizza box has at least one sidewall that is formed having two adjacent panels with a cavity between the adjacent panels, and, a bottom that has at least one slot. The at least one slot is substantially aligned with and provides access to the cavity. And, the leveling device has at least one portion thereof formed for insertion into the at least one slot and further into the cavity of the sidewall of the pizza box so as to detachably attach the leveling device to the pizza box.

Relative to the present invention combination pizza box and leveling device described above, applicant considers the following objectives:

It is another important objective of the present invention that it holds a pizza box, or pizza boxes, in a relatively level position during transportation thereof in a transportation vehicle.

It is an important objective of the present invention that it restricts movement of a pizza box, or pizza boxes, on the seat bottom of a transportation vehicle during acceleration, deceleration, braking and/or turning of the transportation vehicle.

It is another important objective of the present invention that the leveling device provides additional means for advertising by manufacturers, distributors, pizza restaurants etc.

It is another important objective of the present invention that it be simple in design, cost efficient to manufacture and commercially viable.

DETAILED DESCRIPTION OF THE DRAWINGS

The various drawings provided herein are for the purpose of illustrating possible embodiments of the present invention and not for the purpose of limiting same. Therefore, the drawings herein represent only a few of the many possible embodiments and/or variations of the present invention.

Figure 1:
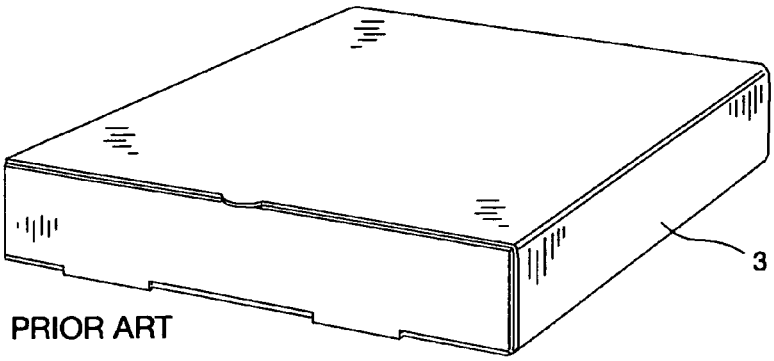
FIG. 1 shows a right front perspective view of a prior art pizza box.

FIG. 1 shows a right front perspective view of a typical prior art pizza box. Pizza box 3 is usually a reinforced cardboard box designed to containerize a fresh pizza pie for handling and transporting often by way of a car or truck, etc.

Figure 2:
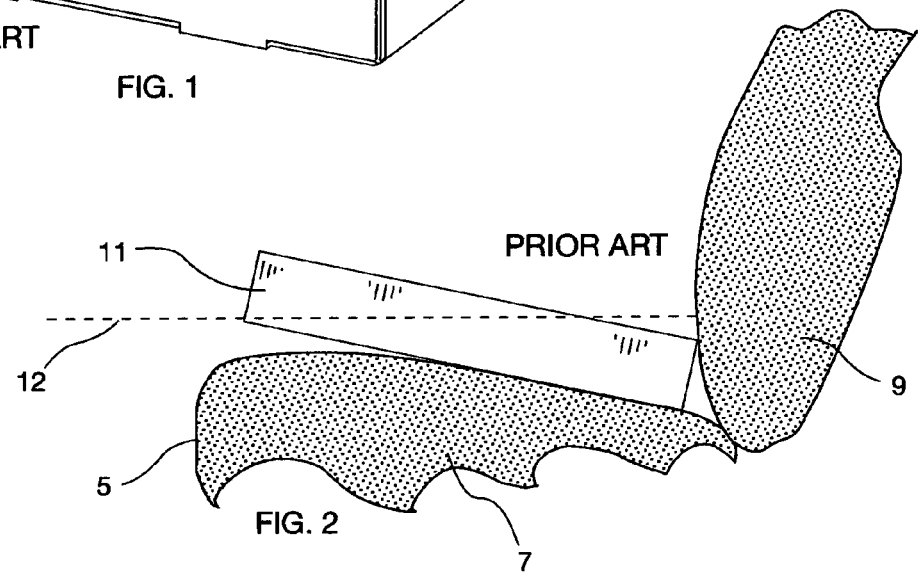
FIG. 2 shows a right side cut view of a seat of a transportation vehicle with a right side view of a prior art pizza box resting on the seat; and, FIG. 3 shows a right side cut view of a typical prior art pizza box; and, FIG. 4 shows a bottom cut view of the typical prior art pizza box shown in FIG. 3; and, FIG. 5 shows a front elevational view of an embodiment of the present invention combination pizza box and leveling device; and, FIG. 6 shows a front elevational view of another embodiment of the present invention combination pizza box and leveling device; and, FIG. 7 shows a front elevational view of another embodiment of the present invention combination pizza box and leveling device; and, FIG. 8 shows a front elevational view of another embodiment of the present invention combination pizza box and leveling device; and, FIG. 9 shows a right side cut view of a seat of a transportation vehicle with a right side view of an embodiment of the present invention combination pizza box and leveling device resting on the seat; and, FIG. 10 shows a right side cut view of a seat of a transportation vehicle with a right side view of an embodiment of the present invention combination pizza box and leveling device resting upon the seat, and, another present invention combination pizza box and leveling device resting upon the pizza box resting upon the seat.

FIG. 2 shows a right side cut view of a seat of a transportation vehicle with a right side view of a typical prior art pizza box resting on the seat. A transportation vehicle shall be defined herein as any vehicle that could be used to transport pizza in pizza boxes including cars trucks etc. Pizza box 11 is resting on the surface of seat bottom 5 of seat 7 and touching seat backrest 9. When a pizza pie is ordered by a customer, it is typically baked and then put in a pizza box while still hot, for delivery to or pick-up by a customer. Transporting a freshly baked pizza can be challenging because the ingredients (especially when hot) tend to flow off the pizza pie if the pizza box is not kept reasonably level. Nonetheless, a common place to rest a pizza box for transportation is on a seat surface of a transportation vehicle (car truck etc.); however, most seating surfaces are not level and tilted downward at the back to accommodate human ergonomics such as seat bottom 5 of seat 7 as shown. Accordingly, when pizza box 11 is placed upon a seat of a transportation vehicle such as seat bottom 5 of seat 7, pizza box 11 is not level relative to a level plane 12 as shown. Accordingly, when a pizza pie is transported this way it is common for the hot ingredients to flow off of the pizza pie and out of the pizza box. This affects visual presentation and edibility of the pizza pie, not to mention the need to clean up the transportation vehicle. In addition, unless pizza box 11 is secured to the seat of the transportation vehicle, it will easily slide around banging into things or even falling off the seat during acceleration, deceleration, braking and/or turning of the transportation vehicle. Clearly, there is a need for a better way to transport pizza box 11.

Figure 3:
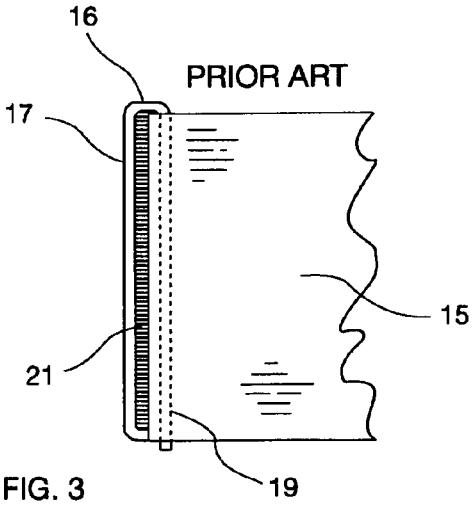

FIG. 3 shows a right side cut view of a typical prior art pizza box 15 with front sidewall 16 folded over creating adjacent sidewall panels 17 and 19, and a cavity 21 between the adjacent sidewall panels as shown.

Figure 4:
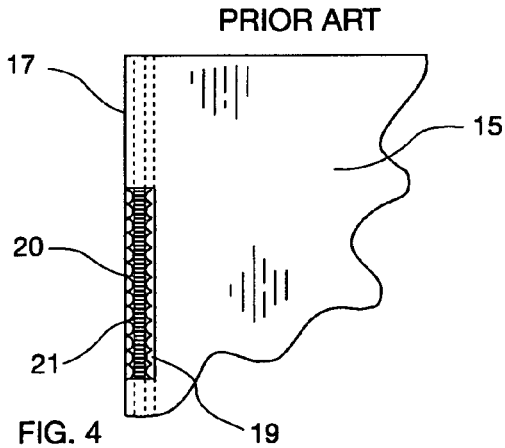

FIG. 4 shows a bottom cut view of the typical prior art pizza box shown in FIG. 3, further showing slot 20 which is substantially aligned with inner cavity 21. Slot 20 provides access to inner cavity 21 between adjacent panels 17 and 19 of front sidewall 16 of pizza box 15 as shown.

Figure 5:
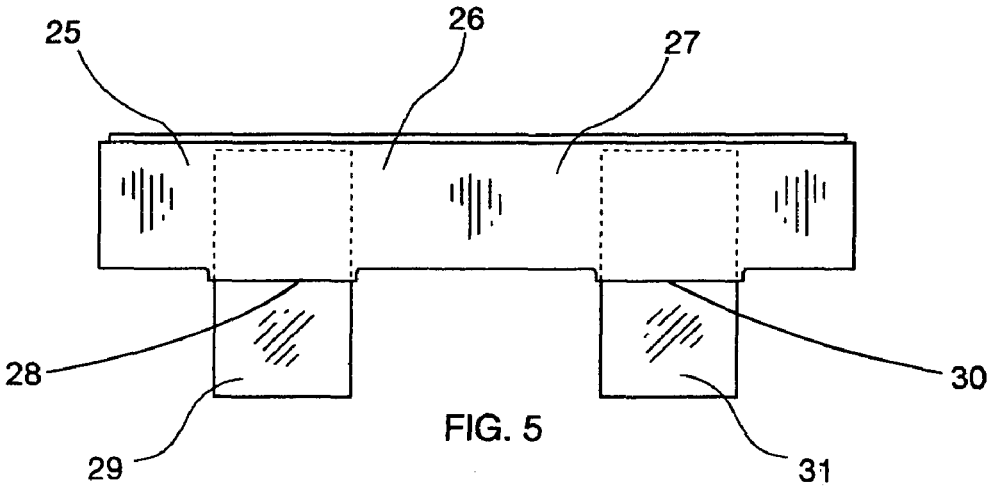

FIG. 5 shows a front elevational view of an embodiment of the present invention combination pizza box and leveling device 25 with pizza box 26 and a leveling device comprising two pieces 29 and 31. Pizza box 26 has a front sidewall 27 and slots 28 and 30 as shown. So as not to be overly redundant with drawing Figures, the construction of front sidewall 27 is the same as or similar to sidewall 16 of FIG. 3; and, slots 28 and 30 are each the same as or similar to slot 20 of FIG. 4. Accordingly, front sidewall 27 of pizza box 26 is formed having two adjacent panels with a cavity between the adjacent panels; and, slots 28 and 30 are each substantially aligned with and provide access to the cavity of front sidewall 27 of pizza box 26. Combination pizza box and leveling device 25 also has a leveling device which comprises two pieces 29 and 31. Leveling device piece 29 has a portion thereof formed for insertion into slot 28 and into the cavity of sidewall 27 of pizza box 26; and, leveling device piece 31 has a portion thereof formed for insertion into slot 30 and into the cavity of sidewall 27 of pizza box 26. (Again, so as not to be overly redundant with drawing Figures, each cavity of front sidewall 27 is constructed the same as or similar to cavity 21 of front sidewall 16 in FIG. 3; and, slots 28 and 30 are each constructed the same as or similar to slot 20 of FIG. 4.) Leveling device pieces 29 and 31are each formed to be detachably attached to pizza box 26. Therefore, each may be easily attached to or detached from pizza box 26. Leveling device pieces 29 and 31 are each formed from a corrugated cardboard material the same as or similar to the typical corrugated cardboard material used for pizza boxes. Even though leveling device pieces 29 and 31 could be made from a variety of different materials, applicant contemplates the use of the typical corrugated cardboard used for pizza boxes, because of its simplicity and cost-efficiency. Another alternative might be to mold or stamp-cut leveling device pieces 29 and 31 from an inexpensive plastic type material. Leveling device pieces 29 and 31 are each formed with predetermined dimensions, particularly in height, to prop up the sidewall 27 of pizza box 26 to a predetermined height so when combination pizza box and leveling device 25 are placed on the seat of a transportation vehicle, pizza box 26 achieves a level position, or at least a position more level than it would otherwise be without the leveling device pieces 29 and 31. This may be more readily understood in conjunction with FIGS. 9 and 10. So in this embodiment of the present invention, combination pizza box and leveling device 25 comprises at least two slots (28 and 30) and the leveling device comprises at least two pieces (29 and 31.)

Figure 6:
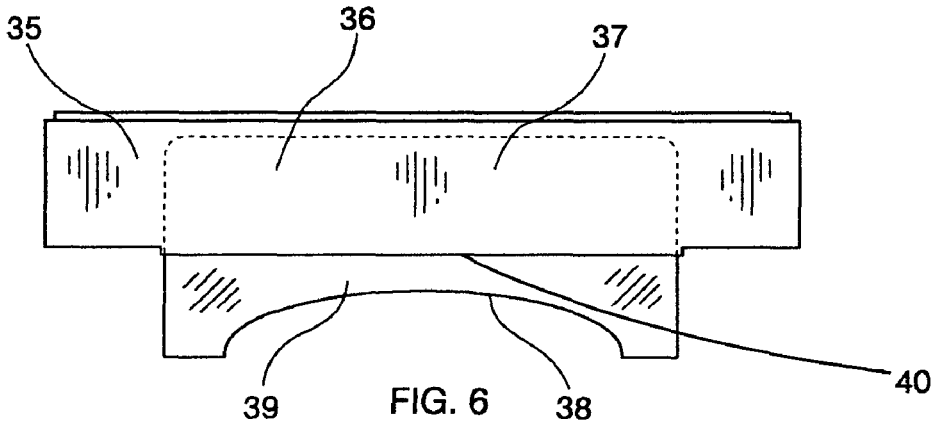

FIG. 6 shows a front elevational view of an embodiment of the present invention combination pizza box and leveling device 35 with pizza box 36 and a leveling device 39 comprising one piece. Pizza box 36 has a front sidewall 37 and slot 40 as shown. So as not to be overly redundant with drawing Figures, the construction of front sidewall 37 is the same as or similar to sidewall 16 of FIG. 3; and, slot 40 is the same as or similar to slot 20 of FIG. 4, but longer. Accordingly, front sidewall 37 of pizza box 36 is formed having two adjacent panels with a cavity between the adjacent panels; and, slot 40 is substantially aligned with and provides access to the cavity of front sidewall 37 of pizza box 36. Combination pizza box and leveling device 35 also has a leveling device 39. Leveling device 39 has a portion thereof formed for insertion into slot 40 and into the cavity of sidewall 37 of pizza box 36. (Again, so as not to be overly redundant with drawing Figures, the cavity of front sidewall. 37 is constructed the same as or similar to cavity 21 of front sidewall 16 in FIG. 3; and, slot 40 is constructed the same as or similar to slot 20 of FIG. 4, although longer.) Leveling device 39 is formed to be detachably attached to pizza box 36. Therefore, leveling device 39 may be easily attached to or detached from pizza box 36. Leveling device 39 is formed from a corrugated cardboard material the same as or similar to the typical corrugated cardboard material used for pizza boxes. Even though leveling device 39 could be made from a variety of different materials, applicant contemplates the use of the typical corrugated cardboard used for pizza boxes, because of its simplicity and cost-efficiency. Another alternative might be to mold or stamp-cut leveling device 39 from an inexpensive plastic type material. Leveling device 39 is formed with predetermined dimensions, particularly in height, to prop up the sidewall 37 of pizza box 36 to a predetermined height so when combination pizza box and leveling device 35 are placed on the seat of a transportation vehicle, pizza box 36 achieves a level position, or at least a position more level than it would otherwise be without the leveling device 39. This may be more readily understood in conjunction with FIGS. 9 and 10. So in this embodiment of the present invention, combination pizza box and leveling device 35 comprise at least one slot (40) and the leveling device comprises one piece (39.) Note that leveling device 39 is further formed with cut-out opening 38 to accommodate a hand of one holding pizza box 36 at sidewall 37 where leveling device 39 is attached.

Figure 7:
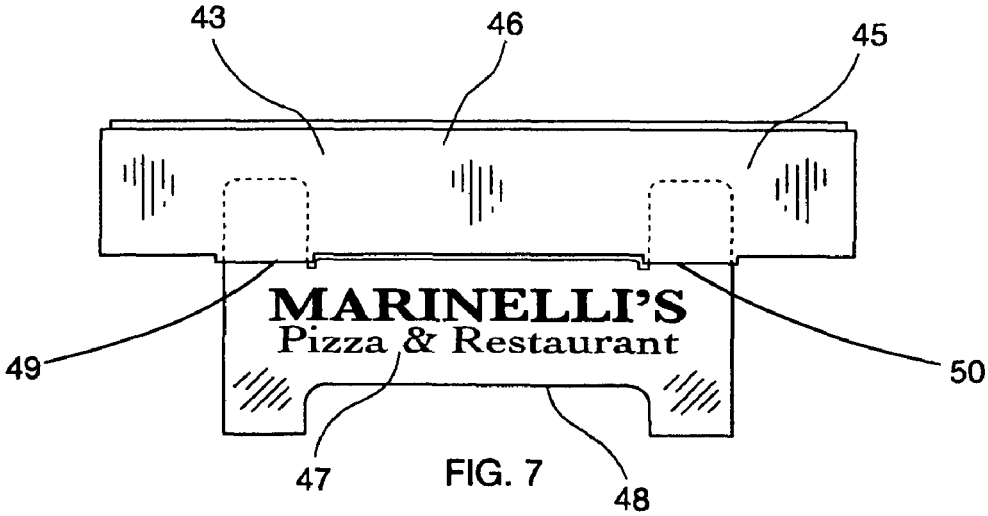

FIG. 7 shows a front elevational view of an embodiment of the present invention combination pizza box and leveling device 43 with pizza box 46 and a leveling device 47. Pizza box 46 has a front sidewall 45 and slots 49 and 50 as shown. Once again, so as not to be overly redundant with drawing Figures, the construction of front sidewall 45 is the same as or similar to sidewall 16 of FIG. 3; and, slots 49 and 50 are each the same as or similar to slot 20 of FIG. 4. Accordingly, front sidewall 45 of pizza box 46 is formed having two adjacent panels with a cavity between the adjacent panels; and, slots 49 and 50 are each substantially aligned with and provide access to the cavity of front sidewall 45 of pizza box 46. Combination pizza box and leveling device 43 also has a leveling device 47. Leveling device 47 has at least a portion thereof formed for insertion into slots 49 and 50 and further into the cavity of sidewall 45 of pizza box 46. (Again, so as not to be overly redundant with drawing Figures, the cavity of front sidewall 45 is constructed the same as or similar to cavity 21 of front sidewall 16 in FIG. 3; and, slots 49 and 50 are each constructed the same as or similar to slot 20 of FIG. 4.) It is intended that leveling device 47 have at least a portion thereof formed for insertion into the cavity of front sidewall 45 and between its two adjacent panels via slots 49 and 50 so as to provide stability to leveling device 47 at its attachment to pizza box 46. Nonetheless, leveling device 47 is formed to be detachably attached to pizza box 46 and may be, therefore, easily attached or detached from pizza box 46. Leveling device 47 is formed from a reinforced cardboard material. This could be any type of reinforced cardboard including corrugated versions. Another alternative might be to mold or stamp-cut leveling device 47 from an inexpensive plastic type material. Leveling device 47 is formed with predetermined dimensions, particularly in height, to prop up the sidewall 45 of pizza box 46 to a predetermined height so when combination pizza box and leveling device 43 are placed on the seat of a typical transportation vehicle, pizza box 46 achieves a level position, or at least a position more level than it would otherwise be without leveling device 47. This may be more readily understood in conjunction with FIGS. 9 and 10. So in this embodiment of the present invention, combination pizza box and leveling device 43 comprise at least two slots (49 and 50); and the leveling device comprises a single piece (47.) Note that leveling device 47 is further formed with cut-out opening 48 at its bottom to accommodate a hand of one holding pizza box 46 at sidewall 45 where leveling device 39 is attached. And, there is sufficient space on leveling device 47 for a manufacturer, distributor, restaurant owner, etc. to advertise for the benefit of one or more of them.

Figure 8:
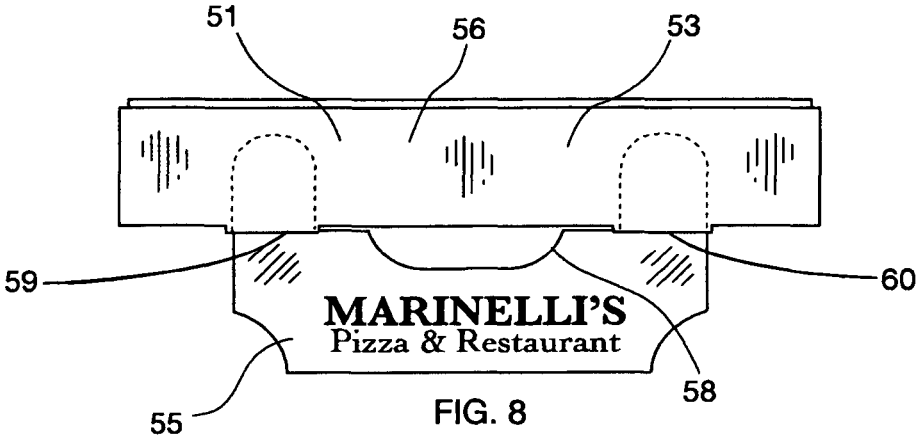

FIG. 8 shows a front elevational view of a preferred embodiment of the present invention combination pizza box and leveling device 51 with pizza box 56 and a leveling device 55. Pizza box 56 has a front sidewall 53 and slots 59 and 60 as shown. Once again, so as not to be overly redundant with drawing Figures, the construction of front sidewall 53 is the same as or similar to sidewall 16 of FIG. 3; and, slots 59 and 60 are each the same as or similar to slot 20 of FIG. 4. Accordingly, front sidewall 53 of pizza box 56 is formed having two adjacent panels with a cavity between the adjacent panels; and, slots 59 and 60 are each substantially aligned with and provide access to the cavity of front sidewall 53 of pizza box 56. Combination pizza box and leveling device 51 also has a leveling device 55. Leveling device 55 has at least a portion thereof formed for insertion into slots 59 and 60 and further into the cavity of sidewall 53 of pizza box 56. (Again, so as not to be overly redundant with drawing Figures, the cavity of front sidewall 56 is constructed the same as or similar to cavity 21 of front sidewall 16 in FIG. 3, and, slots 59 and 60 are each constructed the same as or similar to slot 20 of FIG. 4.) It is intended that leveling device 55 have at least a portion thereof formed for insertion into the cavity of front sidewall 53 and between its two adjacent panels via slots 59 and 60 so as to provide stability to leveling device 55 at its attachment to pizza box 56. Nonetheless, leveling device 55 is formed to be detachably attached to pizza box 56 and may be, therefore, easily attached to or detached from pizza box 56. Leveling device 55 may be made from almost any material, but a reinforced cardboard type material is contemplated. Another alternative might be to mold or stamp-cut leveling device 55 from an inexpensive plastic type material. Leveling device 55 is formed with predetermined dimensions, particularly in height, to prop up the sidewall 53 of pizza box 56 to a predetermined height so when combination pizza box and leveling device 51 are placed on the seat of a typical transportation vehicle, pizza box 56 achieves a level position, or at least a position more level than it would otherwise be without the leveling device 55. This may be more readily understood in conjunction with FIGS. 9 and 10. So in this embodiment of the present invention, combination pizza box and leveling device 51 comprise at least two slots (59 and 60); and, the leveling device comprises one piece (55.) Note that leveling device 55 is further formed with cut-out opening 58 at its top to accommodate a hand of one holding pizza box 56 at sidewall 53 where leveling device 55 is attached. And, there is the bonus of additional space on leveling device 55 for a manufacturer, distributor, restaurant owner, etc. to advertise for the benefit of one or more of them.

Figure 9:
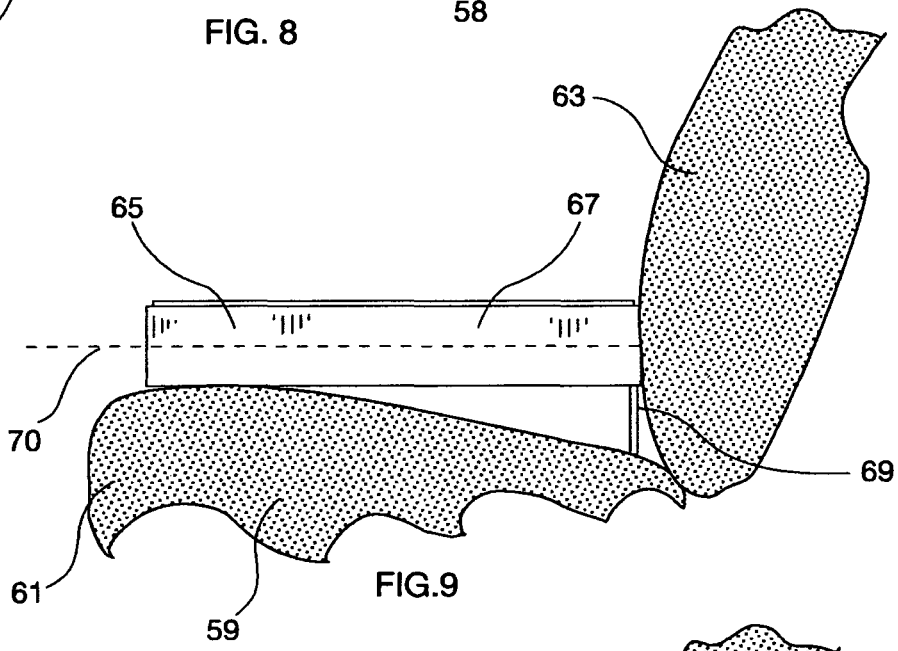

FIG. 9 shows a right side cut view of a seat of a transportation vehicle with a right side view of an embodiment of the present invention combination pizza box and leveling device resting on the seat. Combination pizza box and leveling device 65 is resting on the surface of seat bottom 61 and touching seat backrest 63 of seat 59. Pizza box 67 is propped up by leveling device 69 so that pizza box 67 is level or close to level plane 70 as shown. And the weight of a pizza pie and pizza box upon leveling device 69 nests leveling device 69 slightly into seat bottom 61 so that pizza box 67 is not only kept relatively level, but also relatively secure from movement during acceleration, deceleration, braking and/or turning of the transportation vehicle. Accordingly, when a pizza pie is transported this way, the hot ingredients will not flow off of the pizza pie and out of the pizza box, visual presentation and edibility of the pizza pie are not compromised, and, there is no need to clean up the transportation vehicle.

Figure 10:
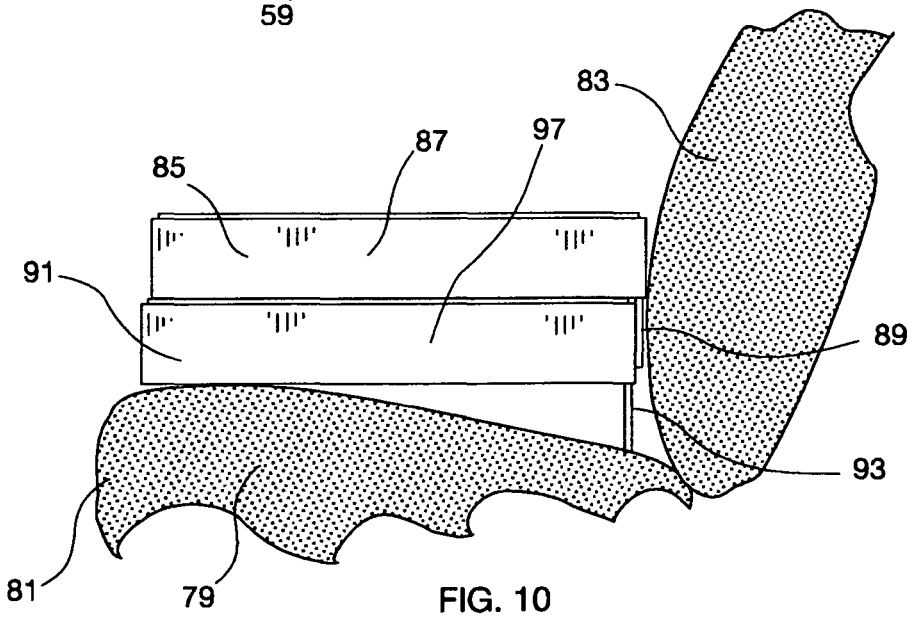

FIG. 10 shows a right side cut view of a seat of a transportation vehicle with a right side view of an embodiment of the present invention combination pizza box and leveling device resting upon the seat, and, another present invention combination pizza box and leveling device resting upon the pizza box resting upon the seat. Combination pizza box and leveling device 91 is resting on the surface of seat bottom 81 of seat 79. Pizza box 97 is propped up by leveling device 93 so that pizza box 97 is level or close to being level during transportation. Combination pizza box and leveling device 85 is positioned and resting upon combination pizza box and leveling device 91 as shown. And, the weight of both pizza pies and pizza boxes upon leveling device 93 nests leveling device 93 slightly into seat bottom 81 so that pizza box 97 is not only kept relatively level, but also relatively secure from movement during acceleration, deceleration, braking and/or turning of the transportation vehicle. And, leveling device 89 attached to pizza box 87 is nested between pizza box 97 and seat back 83 of seat 79 to ensure that the pizza box 87 is not only kept relatively level, but also relatively secured from movement during acceleration, deceleration, braking and/or turning of the transportation vehicle. So it is easy to see how the present invention combination pizza box and leveling device may be used to facilitate transportation of a pizza in a pizza box, or two, or several, stacked upon each other.

Although illustrative embodiments of the present invention have been described herein in detail, it should be noted and will be appreciated by those skilled in the art that numerous variations may be made within the scope of this invention without departing from the principles and chief advantages of this invention. Unless otherwise specifically stated, the terms and expressions have been used herein as terms of description and not limitation. There is no intention to use the terms or expressions to exclude any equivalents of features shown and described or portions thereof, and this invention should be predetermined in accordance with the claims that follow, or the equivalence thereof.

Having thus described the invention, the following is claimed:

1. A combination of a pizza box and leveling device for said pizza box, the combination comprising:

said pizza box comprising a side wall including adjacent inner and outer panels forming a cavity therebetween, and a bottom having at least one slot, said at least one slot being aligned with and providing access to said cavity from outside of said pizza box; and, said leveling device comprising at least one piece separate from said pizza box and having at least one portion thereof positioned within said at least one slot and into said cavity, said leveling device being detachable from said pizza box without movement of said two adjacent panels with respect to each other and without bending or tearing of said leveling device or said bottom, said leveling device being formed to prop up a side of said pizza box to a predetermined height so that when said combination pizza box and leveling device are placed on the seat of a transportation vehicle, said pizza box achieves a position more level than it would otherwise be without said leveling device.

2. The combination of a pizza box and a leveling device of claim 1, wherein the leveling device provides supporting engagement with said pizza box at the bottom of said pizza box.

3. The combination of a pizza box and a leveling device of claim 1, wherein said pizza box has a front end, and a back end defined by a side wall with a connecting lid for said pizza box, and, said at least one slot is positioned towards the front end of said pizza box.

4. The combination of a pizza box and a leveling device of claim 1, wherein the bottom of said pizza box has two slots.

5. The combination of a pizza box and a leveling device of claim 1, wherein said leveling device is one piece.

6. The combination of a pizza box and a leveling device of claim 1, wherein said leveling device has an outer portion extending outside of said cavity, and, said outer portion has a cut out opening to facilitate holding and carrying of said pizza box.

7. The combination of a pizza box and a leveling device of claim 1, wherein said leveling device comprises a cardboard type material.

8. The combination of a pizza box and a leveling device of claim 1, wherein said leveling device comprises a plastic type material.

9. The combination of a pizza box and a leveling device of claim 2, wherein said pizza box has a front end, and a back end defined by a side wall with a connecting lid for said pizza box, and, said at least one slot is positioned towards the front end of said pizza box.

10. The combination of a pizza box and a leveling device of claim 2, wherein the bottom of said pizza box has two slots.

11. The combination of a pizza box and a leveling device of claim 2, wherein the leveling device is one piece.

12. The combination of a pizza box and a leveling device of claim 2, wherein said leveling device has an outer portion extending outside of said cavity, and, said outer portion has a cut out opening to facilitate holding and carrying of said pizza box.

13. A combination of a pizza box and leveling device for said pizza box, the combination comprising:

said pizza box comprising a side wall including adjacent inner and outer panels connected at the top of each of said inner and outer panels and forming a cavity therebetween, and a bottom having at least one slot, said at least one slot being aligned with and providing access to said cavity from outside of said pizza box; and, said leveling device comprising at least one piece separate from said pizza box and having at least one portion thereof positioned within said at least one slot and into said cavity and at least one portion positioned exteriorly of the cavity, said at least one portion within said cavity contacting said connection at the top of each of said inner and outer panels to allow said leveling device to support said pizza box and said leveling device being exteriorly separable from said cavity and reusable to support another pizza box, said leveling device being formed to prop up a side of said pizza box to a predetermined height so that when said combination pizza box and leveling device are placed on the seat of a transportation vehicle, said pizza box achieves a position more level than it would otherwise be without said leveling device.

14. The combination of a pizza box and a leveling device of claim 13, wherein the leveling device provides supporting engagement with said pizza box at the bottom of said pizza box.

15. The combination of a pizza box and a leveling device of claim 13, wherein said pizza box has a front end, and a back end defined by a side wall with a connecting lid for said pizza box, and, said at least one slot is positioned towards the front end of said pizza box.

16. The combination of a pizza box and a leveling device of claim 13, wherein the bottom of said pizza box has two slots.

17. The combination of a pizza box and a leveling device of claim 13, wherein said leveling device is one piece.

18. The combination of a pizza box and a leveling device of claim 13, wherein said leveling device has an outer portion extending outside of said cavity, and, said outer portion has a cut out opening to facilitate holding and carrying of said pizza box.

19. The combination of a pizza box and a leveling device of claim 13, wherein said leveling device comprises a cardboard type material.

20. The combination of a pizza box and a leveling device of claim 13, wherein said leveling device comprises a plastic type material.

* * * * *